US007946510B2

(12) United States Patent
Huang

(10) Patent No.: US 7,946,510 B2
(45) Date of Patent: May 24, 2011

(54) NOZZLE ASSEMBLY FOR SPRAY GUNS

(76) Inventor: Jung-Kun Huang, Lu Chow (TW)

( * ) Notice: Subject to any disclaimer, the term of this patent is extended or adjusted under 35 U.S.C. 154(b) by 164 days.

(21) Appl. No.: 12/379,323

(22) Filed: Feb. 19, 2009

(65) Prior Publication Data

US 2010/0206963 A1 Aug. 19, 2010

(51) Int. Cl.
*B05B 1/28* (2006.01)

(52) U.S. Cl. ..... 239/290; 239/291; 239/296

(58) Field of Classification Search ..... 239/290–301, 239/391, 392, 394, 437–442
See application file for complete search history.

(56) References Cited

U.S. PATENT DOCUMENTS 5,199,644 A * 4/1993 Haferkorn ..... 239/296
5,217,168 A * 6/1993 Svendsen ..... 239/297
5,429,307 A * 7/1995 Darroch ..... 239/390
6,036,109 A * 3/2000 DeYoung ..... 239/301
6,068,203 A * 5/2000 DeYoung et al. ..... 239/297
6,527,200 B1 * 3/2003 Huang ..... 239/296

* cited by examiner

*Primary Examiner* — Jason J Boeckmann

(57) ABSTRACT

A spray gun includes a nozzle connected to the open end of the spray gun and an air cap having a central passage through which the nozzle extends. The air cap includes symmetrical angular passages and multiple air passages. A back board is located at the back face of the air cap and includes an air outlet portion which includes a central hole and multiple air passages which are independent from the central hole. The nozzle extends through the central hole. Multiple resilient members are located on the back face of the air cap and push the back board to contact the air cap constantly. The air cap includes protrusion on the back face and the back board includes notches in its front face so that when rotating the air cap relative to the back board, the user is acknowledged the angle that the air cap is rotated.

3 Claims, 8 Drawing Sheets

NOZZLE ASSEMBLY FOR SPRAY GUNS

BACKGROUND OF THE INVENTION (1) Field of the Invention

The present invention relates to a spray gun, and more particularly, to a nozzle assembly for a spray gun and the nozzle assembly ensures the back board to be biased onto the splitting head.

(2) Description of the Prior Art

A conventional spray gun 100 for spraying paint or the like is disclosed in U.S. Pat. No. 5,217,168 and shown in FIGS. 1 to 3, which includes an air cap 12 and a back board 13 located in front of the nozzle 11, and the air cap 12 and the back board 13 are positioned by a locking member 14 which is threadedly connected to the spray gun 100. The air cap 12 includes a central passage 121 and multiple shape passages 122 and air passages 123. The back board 13 includes cross-shaped holes 131 through which the paint is ejected therefrom. The air cap 12 can be rotated to allow the air to pass through the air passage 123 and to stock the air to pass through the shape passage 122 to form a circular atomized spray, or to block the air passing through the air passage 123 to form a stream spray.

In order to allow the air cap 12 to rotate, a small gap 15 has to be maintained for the air cap 12 and when operating the spray gun 100, the air pressure pushes the air cap 12 and the back board 13 toward the front end of the spray gun 100, so that the back board 13 will contact the back of the air cap 12. However, the nozzle 11, the air cap 12 and the back board 13 have to be cleaned regularly, and when they are assembled to the spray gun 100, the locking member 14 might not be positioned properly and this results in a large gap formed between the air cap 12 and the back board 13. The relative positions between the air cap 12 and the back board 13 may not be correctly set. These installation problems reduces the back pressure when the back board 13 contacts the air cap 12 and increases the power loss to the electric motor and generates high temperature.

The cross shaped holes 131 are in communication with each other so that when the air cap 12 and the back board 13 are not correctly set, the air passes through all of the central passage 121, the shape passages 122 and the air passages 123. The center and the four distal ends of the cross-shaped holes 131 are not independently operated.

When operating the spray gun 100, the back board 13 contacts the air cap 12 by the wind pressure, and when the spray gun 100 is not operated, there will be no wind pressure and turbulent is generated.

When rotating the air cap 12, the user cannot be acknowledged the angle that the air cap 12 is actually moved, and the user cannot know which of the shape passages 122 or the air passages 123 that the paint goes through. The user then has to try by spraying a small amount of the paint to check that the air cap 12 is correctly rotated.

SUMMARY OF THE INVENTION

The present invention relates to a spray gun which comprises a hollow cylindrical part located at a front end of the spray gun and an open end is defined in a front end of the hollow cylindrical part. A nozzle assembly includes a nozzle connected to the open end of the hollow cylindrical part and a piston rod is movably inserted into the nozzle. An air cap has a central passage, multiple angular passages and multiple air passages. A back board is located at a back face of the air cap and includes an air outlet portion which includes a central hole and multiple air passages which are independent from the central hole. Multiple resilient members are located on the back face of the air cap and push the back board to contact the air cap.

The primary object of the present invention is to provide a to provide a nozzle assembly for spray gun and the back board is ensured to contact against the air cap by springs so as to improve the drawbacks of the conventional spray gun mentioned above.

Another object of the present invention is to provide a to provide a nozzle assembly wherein the user is acknowledged the angle that the air cap is rotated by engaging the protrusions on the air cap with the notches on the back board.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
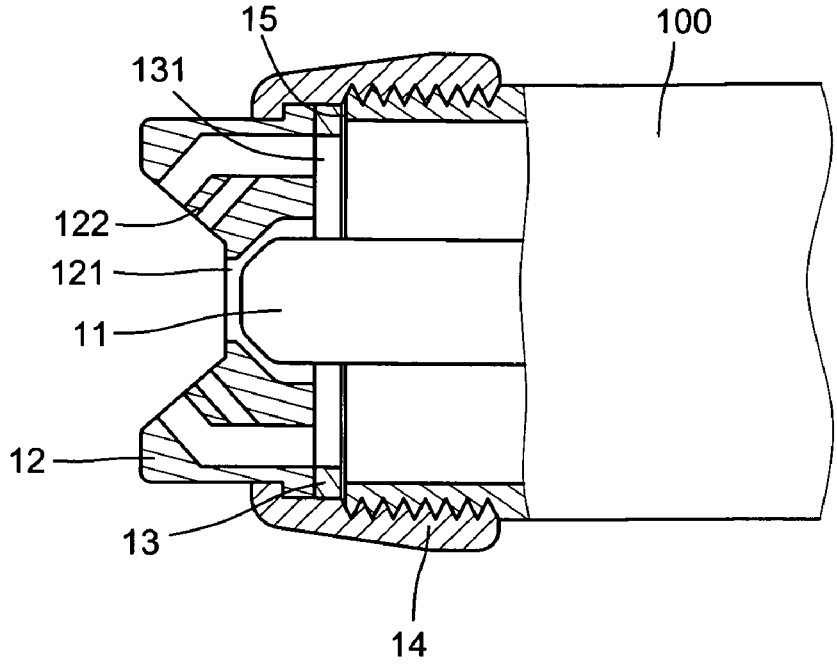
FIG.1 Prior Art
FIG. 1 is a partial cross sectional view to show the conventional nozzle assembly.
Figure 3:
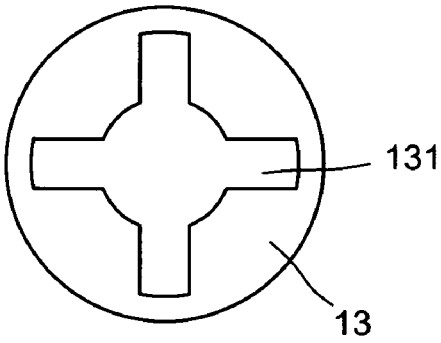
FIG.3 Prior Art
FIG. 3 shows the back board of the conventional nozzle assembly.
Figure 2:
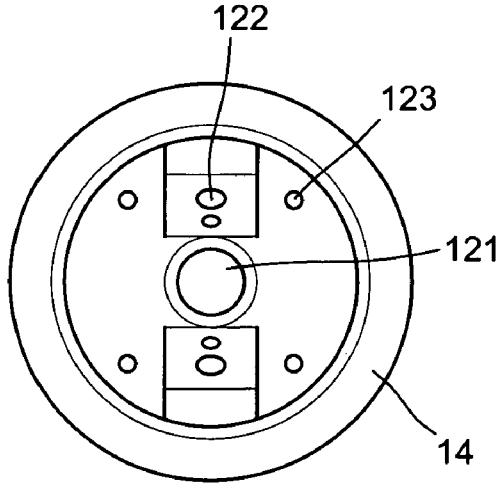
FIG.2 Prior Art
FIG. 2 shows the air cap of the conventional nozzle assembly.
Figure 4:
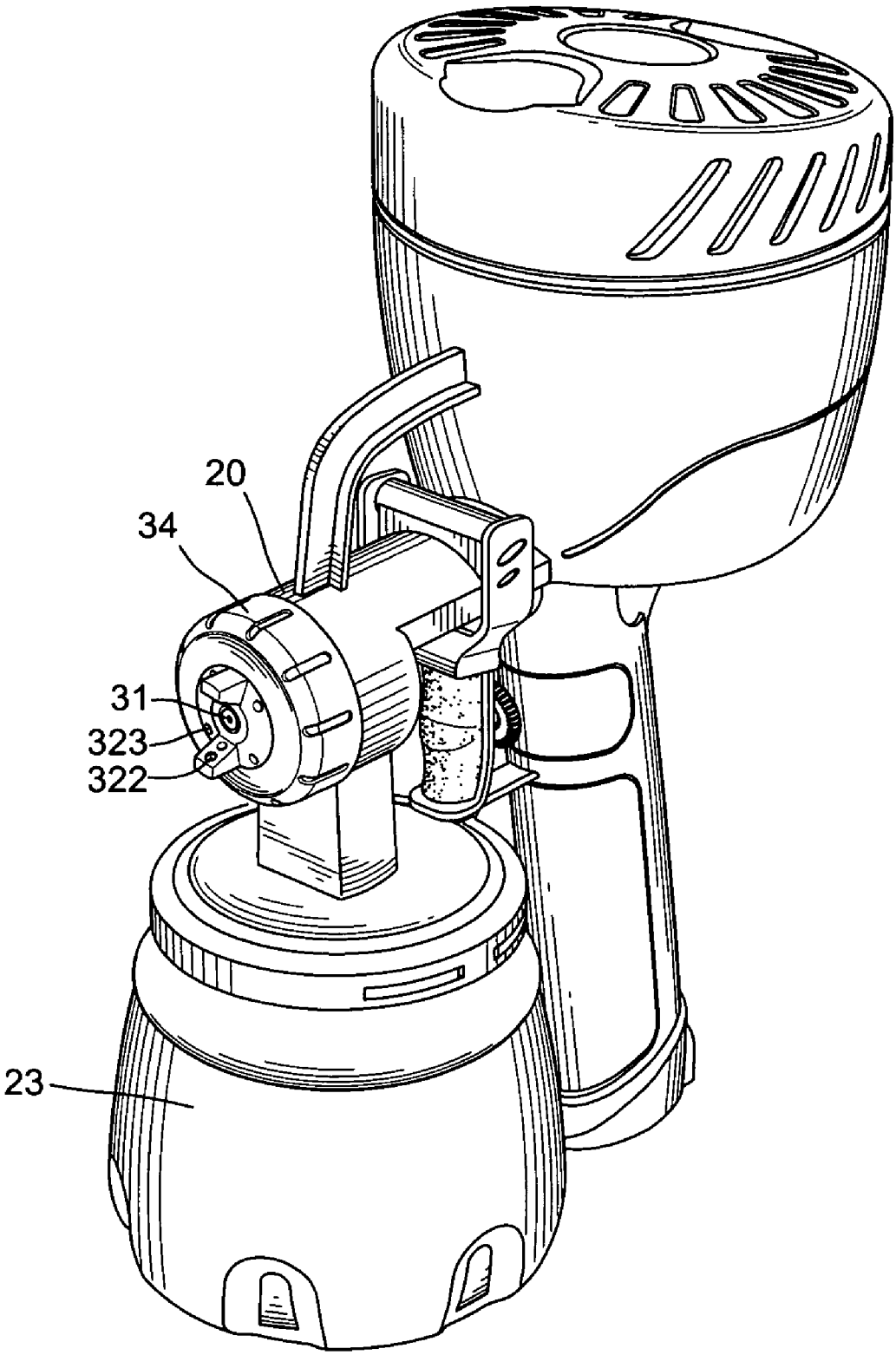
FIG. 4 is a perspective view to show the spray gun with the nozzle assembly of the present invention.
Figure 5:
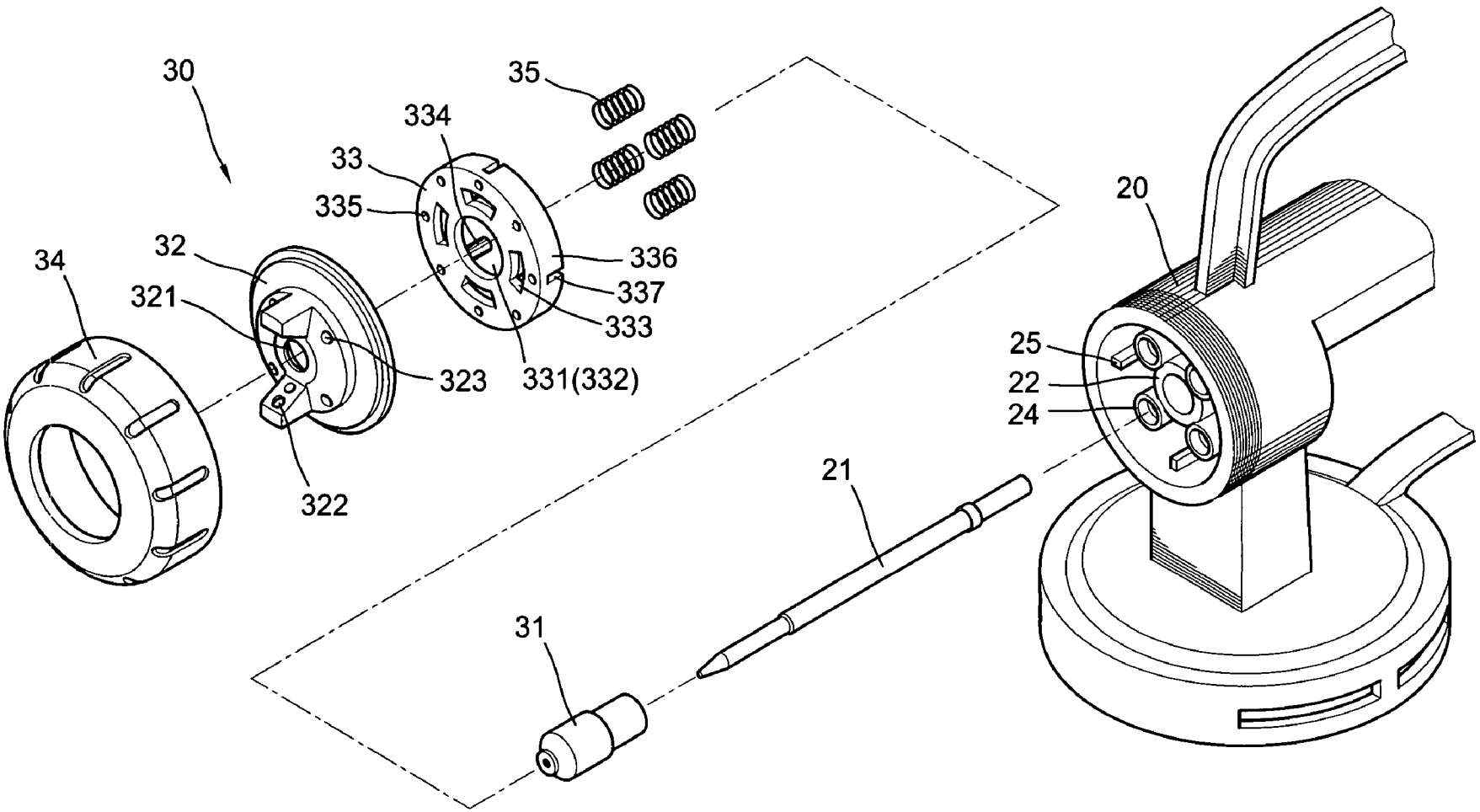
FIG. 5 is an exploded view to show the spray gun with the nozzle assembly of the present invention.
Figure 6:
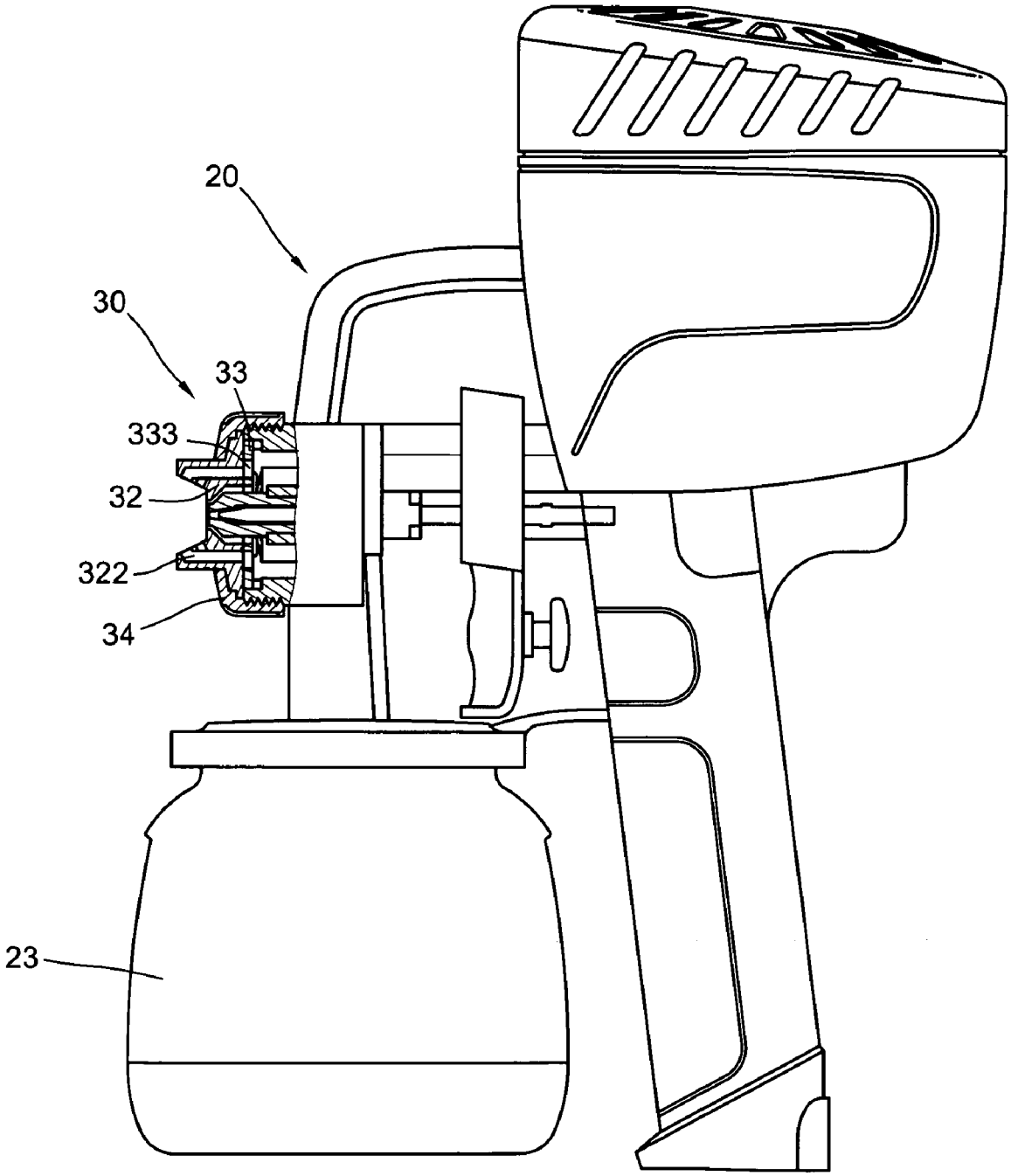
FIG. 6 is a partial cross sectional view of the nozzle assembly on the spray gun of the present invention.

Referring to FIGS. 4 to 6, the spray gun 20 of the present invention comprises a hollow cylindrical part 22 located at a front end of the spray gun 20 and an open end is defined in a front end of the hollow cylindrical part 22. Four reception holes 24 are defined in the front end of the spray gun 20 and four positioning plates 25 extend from the front end of the spray gun 20. A tank 23 is removably connected to the spray gun 20 to provide paint to the spray gun 20.

A nozzle assembly 30 is connected to the front end of the spray gun 20 and comprises a nozzle 31 connected to the open end of the hollow cylindrical part 22 and a piston rod 21 which is movably inserted into the nozzle 31, such that the paint can be ejected from the nozzle 31.

An air cap 32 has a central passage 321, multiple angular passages 322 and multiple air passages 323, wherein the multiple angular passages 322 are defined in two respective insides of two protruding parts on the front face of the air cap 32. The multiple air passages 323 are located symmetrically on the front face of the air cap 32 respectively.

A back board 33 located at the back face of the air cap 32 and includes an air outlet portion 331 which includes a central hole 332 and multiple outlets 333 which are independent from the central hole 332. The back board 33 further includes four positioning studs 334 extending from the back face thereof and four resilient members 35 are mounted to the positioning studs 334. The positioning studs 334 are inserted into the reception holes 24 of the spray gun 20. By the spring forces, the resilient members 35 constantly push the back board 33 to contact the air cap 32. The back board 33 includes a peripheral skirt 336 and four positioning recesses 337 are defined in the peripheral skirt 336.

When assembling the nozzle assembly 30 to the spray gun 20, the nozzle 31 and the piston rod 21 are inserted into the hollow cylindrical part 22, the positioning plates 25 are engaged with the positioning recesses 337, and the positioning studs 334 are inserted into the reception holes 24. This allows the assemblers a convenient and quick way to correct the back board 33 to the spray gun 20. The air cap 32 is then mounted to the back board 33, and the locking member 34 is threadedly connected to the spray gun 20 to position the air cap 32 and the back board 33. Because of the engagement of the positioning plates 25 and the positioning recesses 337, the back board 33 and the air cap 32 can be easily and correctly positioned.

The air cap 32 includes eight protrusions 324 extending from the back face thereof and the back board 33 includes eight notches 335 defined in a front face thereof, the protrusions 324 are removably engaged with the notches 335. When rotating the air cap 32, the engagement of the protrusions 324 and the notches 335 acknowledges the users the desired angle is reached.

Figure 7:
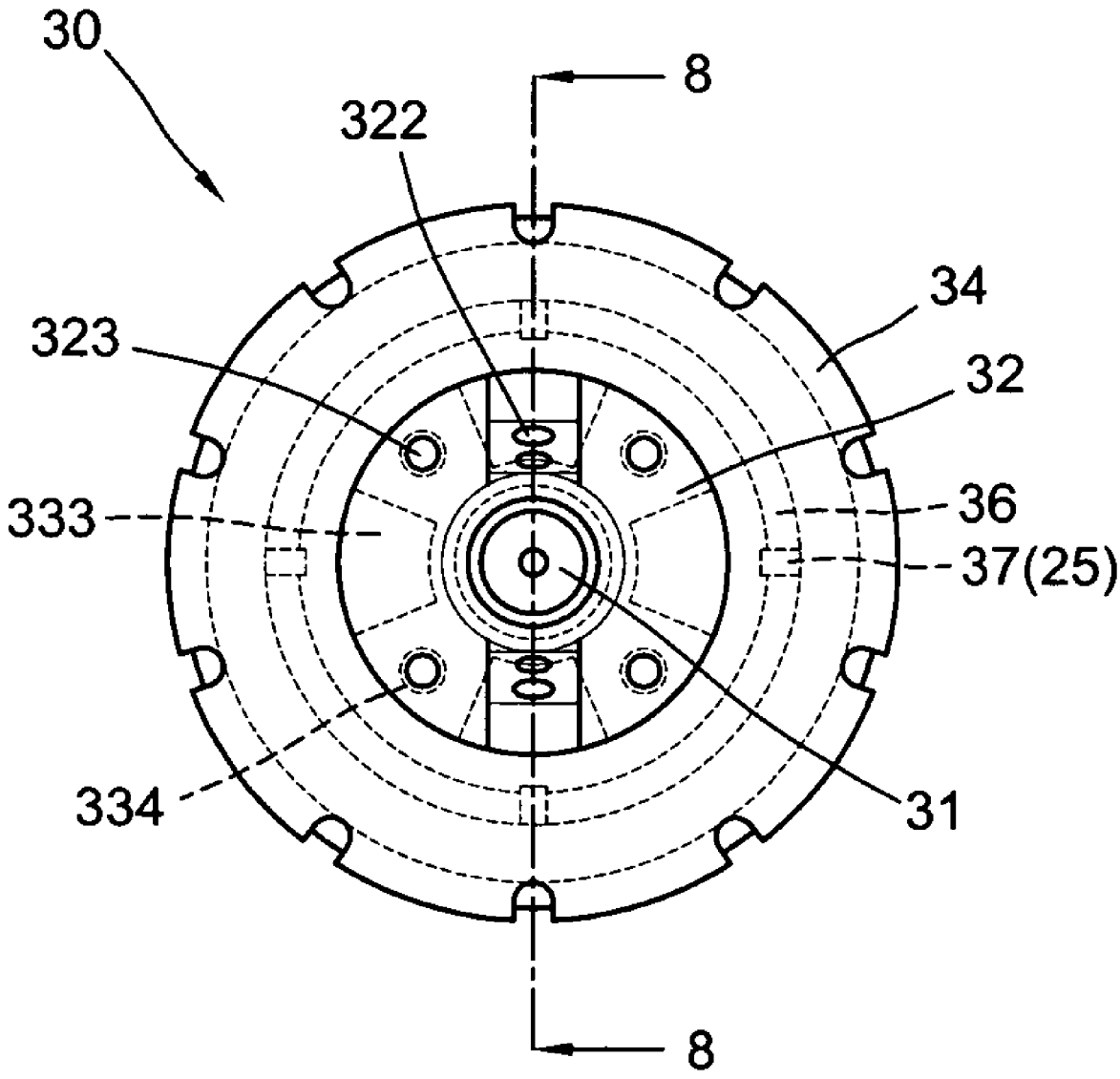
FIG. 7 shows that the air cap is rotated to communicate the angular passages in the air cap with the outlets in the back board of the nozzle assembly of the present invention.
Figure 8:
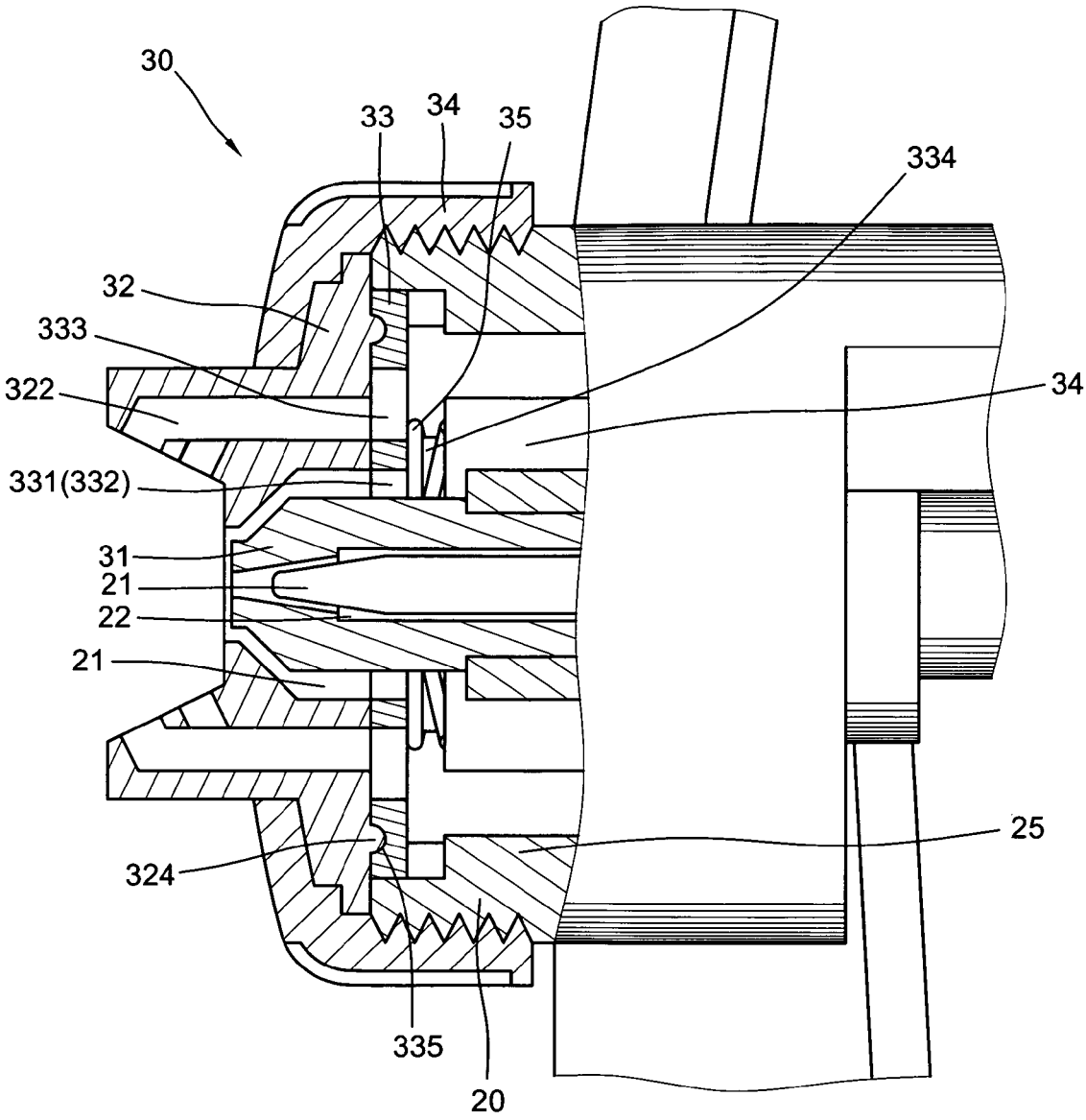
FIG. 8 is a cross sectional view, taken along line 8-8 in FIG. 7.

As shown in FIGS. 7 and 8, when the air cap 32 is rotated to a position that the angular passages 322 in the air cap 32 communicate with the outlets 333 in the back board 33, the air goes through the central hole 332 of the back board 33 and the central passage 321 of the air cap 32, and the air goes through the outlets 333 of the back board 33 and the angular passages 322 of the air cap 32. At this position, the spray gun 20 has an atomized paint spray.

Figure 9:
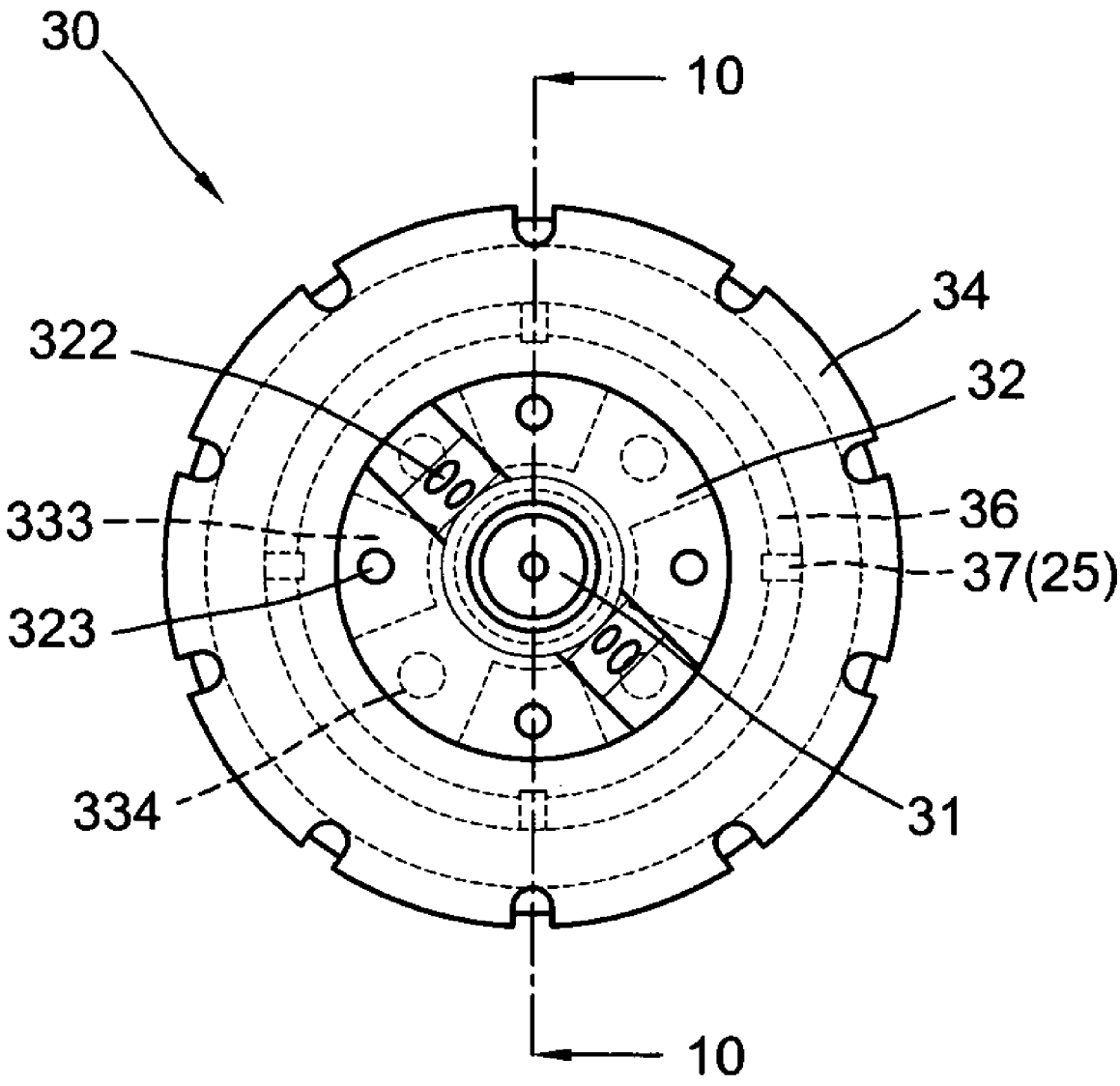
FIG. 9 shows that the air cap is rotated to communicate the angular passages in the air cap with the air passages in the back board of the nozzle assembly of the present invention.
Figure 10:
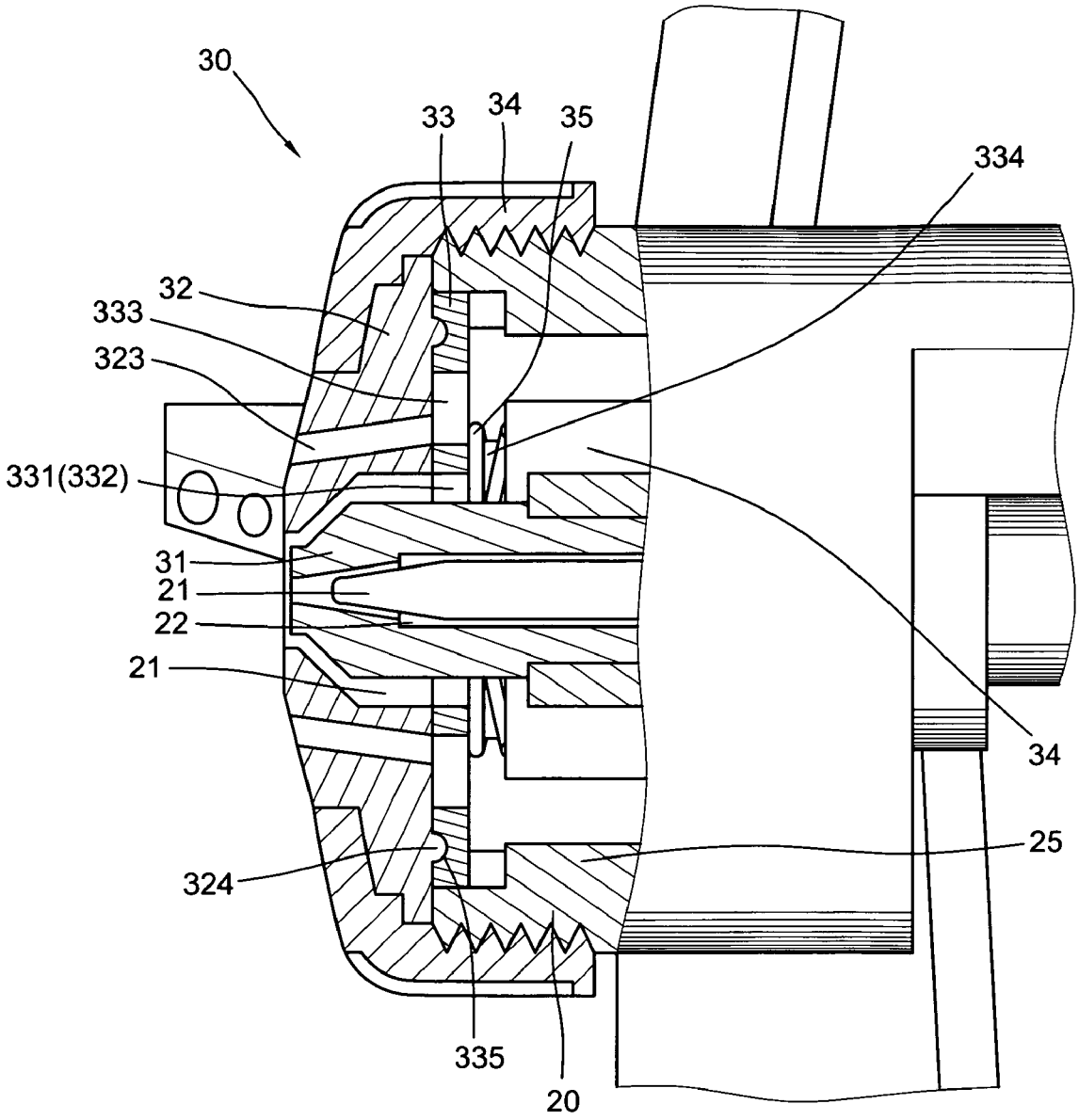
FIG. 10 is a cross sectional view, taken along line 10-10 in FIG. 9.

As shown in FIGS. 9 and 10, when the air cap 32 is rotated to a position that the air passages 323 in the air cap 32 communicate with the outlets 333 in the back board 33, the air goes through the central hole 332 of the back board 33 and the central passage 321 of the air cap 32, and the air goes through the outlets 333 of the back board 33 and the air passages 323 of the air cap 32. At this position, the paint is sprayed in a circular atomized stray.

The resilient members 35 provides a pushing force to the back board 33 so that the back board 33 can constantly contact the air cap 32. The air passing through the central hole 332 and the outlets 333 is guided to the air cap 32 so that the spraying is efficient and the power loss for the electric motor and the temperature can be reduced. The central hole 332 and the outlets 333 are not in communication with each other so as to avoid from turbulent.

While we have shown and described the embodiment in accordance with the present invention, it should be clear to those skilled in the art that further embodiments may be made without departing from the scope of the present invention.

What is claimed is:

1. A spray gun comprising:

a hollow cylindrical part located at a front end of the spray gun and having an open end in a front end thereof;

a nozzle assembly comprising a nozzle connected to the open end of the hollow cylindrical part and a piston rod movably inserted into the nozzle;

an air cap having a central passage, multiple angular passages and multiple air passages, the multiple angular passages and the multiple air passages located symmetrically on a front face of the air cap respectively, and a back board located at a back face of the air cap and having an air outlet portion which includes a central hole and multiple outlets which are independent from the central hole, the back board including multiple positioning studs extending from a back face thereof and multiple resilient members located on the back face of the back board and mounted to the positioning studs so as to push the back board to contact the air cap, the spray gun including multiple reception holes in which the positioning studs are inserted.

2. The spray gun as claimed in claim 1, wherein back board includes a peripheral skirt and multiple positioning recesses are defined in the peripheral skirt, the spray gun includes multiple positioning plates which are engaged with the positioning recesses.

3. The spray gun as claimed in claim 1, wherein the back board includes multiple notches defined in a front face thereof and the air cap includes multiple protrusions extending from the back face thereof, the protrusions are removably engaged with the notches.

* * * * *